United States Patent [19]

Beyer

[11] 4,195,836

[45] Apr. 1, 1980

[54] GAME AND APPARATUS THEREFOR

[76] Inventor: David M. Beyer, 1701 W. Marshall St., Norristown, Pa. 19401

[21] Appl. No.: 903,127

[22] Filed: May 5, 1978

Related U.S. Application Data

[63] Continuation-in-part of Ser. No. 750,168, Dec. 13, 1976, abandoned.

[51] Int. Cl.[2] ..... A63F 9/00

[52] U.S. Cl. ..... 273/1 R; 40/20 R; 40/586

[58] Field of Search ..... 273/1 R; 40/20 R, 586, 40/617, 107; 211/50

[56] References Cited

U.S. PATENT DOCUMENTS

| | | | |
|---|---|---|---|
| 799,997 | 9/1905 | MacLellon | 40/20 R |
| 811,298 | 1/1906 | Kingsbury | 211/50 |
| 1,866,554 | 7/1932 | Fairbanks | 40/617 |
| 1,879,260 | 9/1932 | Howard | 40/107 |
| 2,821,035 | 1/1958 | Joseph | 40/586 |
| 3,167,782 | 2/1965 | Wilson et al. | 40/586 X |
| 3,524,645 | 8/1970 | Breslow | 273/1 R |
| 3,570,158 | 3/1971 | Hackett | 40/586 X |
| 3,829,995 | 8/1974 | Fakoury | 40/586 X |

FOREIGN PATENT DOCUMENTS

| | | | |
|---|---|---|---|
| 786281 | 6/1935 | France | 40/586 |
| 480077 | 12/1969 | Switzerland | 40/586 |

*Primary Examiner*—Paul E. Shapiro

*Attorney, Agent, or Firm*—Edmund M. Jaskiewicz

[57] ABSTRACT

A game in which a flat display panel is suspended by a string or cord around the neck of a player so that the panel is on the back of the player. The panel is provided with hooks or snaps to detachably mount a card thereon containing information on a face of the card so that the information is visible to players but not to the player wearing the card. The cards are divided into categories of information, such as famous people, and each player attempts to guess the identity of the person of the category to which his card relates.

7 Claims, 6 Drawing Figures

GAME AND APPARATUS THEREFOR

RELATED APPLICATION

This application is a continuation-in-part of the copending application by the same applicant, filed Dec. 13, 1976 having Ser. No. 750,168, now abandoned.

The present invention relates to a game, more particularly, to a game in which a display panel is suspended on the back of a player from his neck and a card which is detachably mounted upon the panel and each participant tries to guess the object or person indicated on the face of his card.

Various forms of games have been devised in order to educate and/or entertain. The nature of these games and the apparatus used to play the games is as wide ranging as the ingenuity and imagination of man can propose. Games which educate as well as entertain are of particular interest since both children and adults have a curiosity and desire to learn. The desire to learn can be more effectively put into practice when it is combined with entertainment as in the case of many games.

One particular form of game involves the guessing of identities of various categories of persons or objects based upon various clues. These clues may be derived from a series of questions which when judiciously asked will quickly lead to the identity of the person or thing involved. Various forms of game apparatus have been devised for such guessing games but most of these forms of game apparatus have been devised so as to be positioned upon a surface and the players gather around the game. As a result, the number of players is somewhat limited and it is virtually impossible to play the game unless the particular apparatus is proposed.

It is therefore the principal object of the present invention to provide a novel and improved guessing game.

It is another object of the present invention to provide such a game apparatus and process wherein various categories of cards can be readily attached to and detached from a game panel worn by a player in the game.

It is an additional object of the present invention to provide a simple and inexpensive game apparatus for an educational guessing game and a process for playing the game.

According to one aspect of the present invention, a game is played with two or more players by disposing a rigid flat and rectangular display panel on the back of a player such that the panel is out of sight of the player but will remain in position on the player while the player moves about. A plurality of cards are provided each of which has information on one face thereof in various predetermined categories and each card is shaped to mounted on the display panel. A card is detachably mounted on the display panel by engaging holes in a card with the hook means on the panel such that the player cannot see the information on the card on his back but the information is visible to the other players. The card is removed from the display panel after the player wearing the card has tried to ascertain the information on his card by asking questions of the other players.

A device for use in playing the game may comprise a flat display panel which has a string connected at opposite ends thereof with the string being of sufficient length so as to be positioned around the neck of a player to enable the display panel to be disposed on the back of the player. A card having information on a face thereof is detachably mounted on the panel in such a manner that the card can be readily removed from the panel without removing the panel from the neck of the player.

The panel may be made of plastic so as to be rigid and the mounting means may comprise hooks or snap-on nodules which are engageable with corresponding openings in the cards. The card may have information thereon falling into various categories such as famous people or the like.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
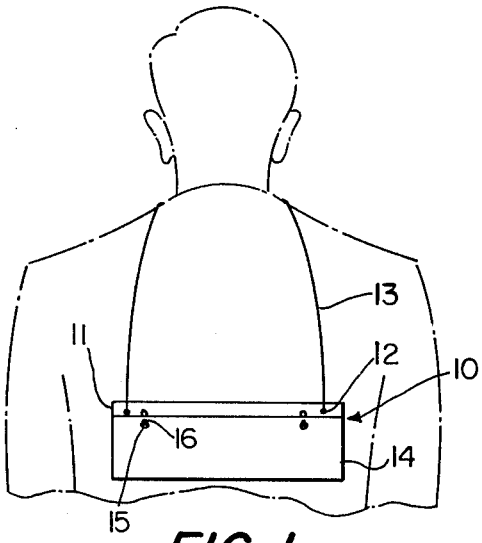
FIG. 1 is a rear elevational view showing the display panel and attached card in position of the back of a player.

As may be seen in FIG. 1, a game apparatus according to the present invention is indicated generally at 10 and is positioned on the back of a player. The game apparatus comprises a display panel 11 which is rectangular, flat and relatively thin such as would be formed of a sheet of plastic and the like. The opposite ends of the panel are provided with holes 12 in which are attached the ends of a string or cord 13 which is flexible and of sufficient length so as to be positioned around the neck of a player and to suspend the panel on the back of the player in the manner as shown in the drawing.

Figure 2:
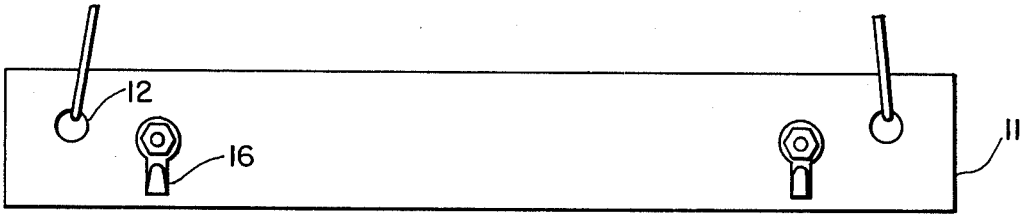
FIG. 2 is an elevational view in enlarged scale of the display panel.
Figure 3:
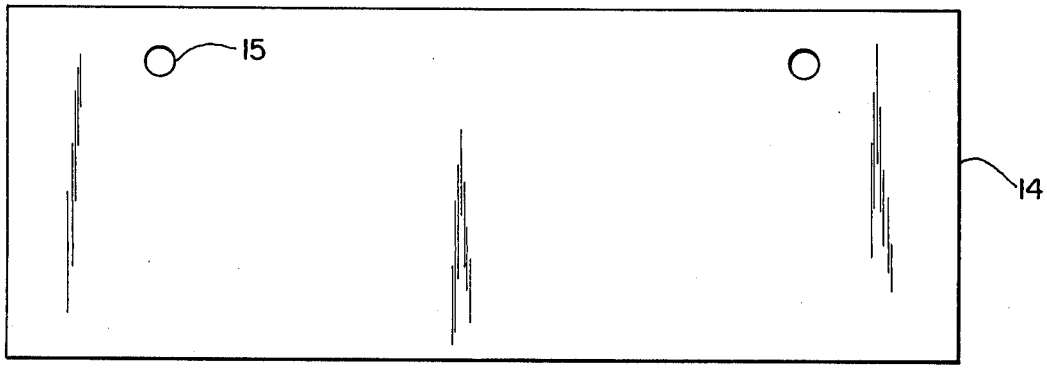
FIG. 3 is an elevational view of the card attached to the display panel showing the side of the card with information thereon.
Figure 4:
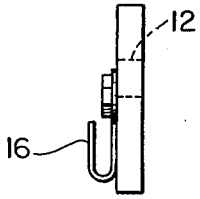
FIGS. 4–6 are side elevational views of the panel of FIG. 2 showing various forms of detachable connectors thereon.

A card 14 is provided with openings 15 which are received by hooks 16 attached to the panel in the manner as shown in FIGS. 2 and 4. The hooks may be secured to the panel by a screw, nut and bolt or suitable adhesive. The card openings 15 are spaced and shaped so as to be readily engaged by the hooks 16 so that the card can be easily attached to the hooks and removed therefrom.

Figure 5:
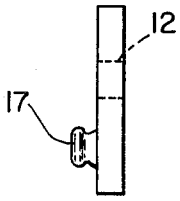
Figure 6:
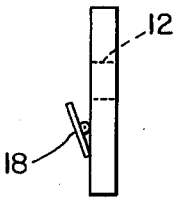

In place of the hooks 16, the panel may be provided with a snap-on nodule 17 as in FIG. 5 or a spring clamp 18 as shown in FIG. 6 for detachably mounting a card thereon. The nodule 17 is snapped through the card opening 15 and the card is detachably mounted thereon. The snap fastener 18 is of the type which is spring-biased into the closed position as shown in FIG. 6 and opens so as to secure the edge of a card thereunder.

On form of a guessing game which can be played with the game apparatus disclosed herein comprises a plurality of cards each having the name of a person thereon and the names of the persons are divided into different categories such as movie stars, sports heroes, statesman, television celebrities, and the like. A card selected at random from the cards of the various categories is then positioned on a display panel on the back of each player. No player can see what name is on the card that he wears. After the players are told the different names of the categories each player asks a question of the other players in an attempt to ascertain the identity of the name on the card attached to his back. While no player knows the name on the card on his back the other players must ascertain this name in order to be able to answer his questions with a "yes" or "no." The exact sequence in which the questions are asked and the scoring of the game can be modified as may be desired.

While the cards may be in categories including names of places or things, the names of persons are desirable since with persons the various players may be called upon to act out the personalities of the people whose names are on their backs.

Other structure may be employed to attach the display panel onto the back of the player and to mount a card on the display panel. The panel may be provided with hooks, clips, or clasps which are attached directly to the clothing of the player so that the necessity for employing a string attached to the ends of the panel is eliminated. The panel can also be attached to the clothing of the player by the use of a suitable adhesive or tape.

The holes in the display panel for the string may be eliminated and the string may be passed through hollow portions or passages formed in the body of the panel. The strng may thus be inserted from the top edge or sides of the display panel.

A plastic strip or band may be employed instead of the above-described string and plastic hooks can be attached to the ends of the strip or band. These hooks will then be received within the holes on the display card. The ends of the plastic band or strip could also be permanently attached to the display card.

The hooks or snap modules on the display panel can be eliminated and the card attached to the panel by having portions thereof received within a hollow center or hollow edges of the display panel. When the display panel is provided with a hollow core or center, the string or band can be passed through the hollow center or core to support the display card and thus eliminate the necessity for the holes in the card. Virtually the entire center of the display panel can be hollow and the opposing surfaces of the card be merely attachd to each other at the corners and perhaps at one or more otherpoints within the perimeter of the display panel. If only a portion of the center of the display panel is hollow it is still possible to pass the string or plastic band through this hollow portion to support the display panel without the use of holes therein. The string or band is then inserted through the hollow chamber between the surfaces of the display panel.

An ordinary pin can also be used to attach the display panel to the clothing of a player by passing the pin through a hole formed in the panel. As a further modification, a flexible belt of plastic or fabric can be attached to the opposite ends of the panel and passed around the chest of the player to be detachably connected at the player's chest by a suitable buckle, clasp, or the like.

The various modifications disclosed herein are for the purpose of facilitating the mounting and removing of the cards from the display panels, to facilitate positioning of the display panels on the backs of the respective players but to enable the panels and cards to be disposed on the back of each player so that particular player cannot view the information on the card carried on his panel. However, the information is visible to the remaining players and the player carrying a card tries to ascertain the information on this card by asking questions of the other players.

Thus it can be seen that the present invention has disclosed a simple and inexpensive game and a device for playing the game. This game device or panel can be used in a wide variety of educational guessing games. The ready attachability and detachability of the different cards onto a display panel on the back of a player enables the game to proceed at a fast and entertaining pace.

It will be understood that this invention is susceptible to modification in order to adapt it to different usages and conditions, and accordingly, it is desired to comprehend such modifications within this invention as may fall within the scope of the appended claims.

What is claimed is:

1. A method of playing a game with two or more players comprising disposing a rigid flat and rectangular display panel on the back of a player such that the panel is out of view of the player and will remain in position on the player while the player moves about, providing a plurality of cards each having information on one face thereof in various predetermined categories and each card shaped to be mounted on the display panel, detachably mounting a card on the display panel by engaging holes in a card with hook means on the panel such that the player cannot see the information on the card on his back but the information is visible to the other players, and removing the card from the display panel after the player wearing the card has tried to ascertain the information on his card by asking questions of the other players.

2. A method as claimed in claim 1 wherein a string is connected to the ends of the display panel and positioning the string over the neck of the player to dispose the display panel on the back of the player.

3. A method as claimed in claim 1 wherein a flexible belt is connected to both ends of the display panel and positioning the belt around the chest of the player to dispose the panel on the back of the player.

4. A method as claimed in claim 1 wherein the display panel is attached to the clothing of the player to disposed the panel on the back of the player.

5. In a method as claimed in claim 1 wherein the panel has hooks thereon and each of the cards has holes therein engageable with the panel hooks.

6. A method as claimed in claim 1 wherein the display panel has a hollow core and a string is passed through the hollow core.

7. A method as claimed in claim 1 and disposing a display panel on the back of each player and mounting a card on each player's panel.

* * * * *